US011172707B1

(12) United States Patent
Harper

(10) Patent No.: US 11,172,707 B1
(45) Date of Patent: Nov. 16, 2021

(54) SMOKING ASSEMBLIES AND METHODS OF SMOKING

(71) Applicant: Claude Harper, Bacliff, TX (US)

(72) Inventor: Claude Harper, Bacliff, TX (US)

( * ) Notice: Subject to any disclaimer, the term of this patent is extended or adjusted under 35 U.S.C. 154(b) by 0 days.

(21) Appl. No.: 16/937,319

(22) Filed: Jul. 23, 2020

(51) Int. Cl.
*A24F 47/00* (2020.01)
*A24F 40/485* (2020.01)

(52) U.S. Cl.
CPC ..... *A24F 40/485* (2020.01)

(58) Field of Classification Search
CPC ..... A61M 15/0086; A24F 42/20; A24F 1/30
See application file for complete search history.

(56) References Cited

U.S. PATENT DOCUMENTS

| | | | | |
|---|---|---|---|---|
| 2,788,085 A | | 4/1957 | Waller | |
| 3,889,690 A | | 6/1975 | Guarnieri | |
| 4,164,230 A | | 8/1979 | Pearlman | |
| 4,259,970 A | * | 4/1981 | Green, Jr. | A24F 47/004 131/185 |
| 10,525,215 B2 | | 1/2020 | Davidson | |
| 2008/0029107 A1 | | 2/2008 | Ruff et al. | |
| 2013/0186398 A1 | * | 7/2013 | Baillet | A61M 15/0021 128/203.15 |
| 2014/0130812 A1 | | 5/2014 | Kling et al. | |
| 2018/0043112 A1 | * | 2/2018 | Zidulka | A61K 9/0073 |
| 2018/0056015 A1 | * | 3/2018 | Shwadchuck | A61M 15/06 |
| 2019/0142061 A1 | | 5/2019 | Haddad | |
| 2019/0230992 A1 | * | 8/2019 | Blick | A61M 15/06 |

FOREIGN PATENT DOCUMENTS

WO WO2019138325 A1 1/2019

* cited by examiner

*Primary Examiner* — Eric Yaary
(74) *Attorney, Agent, or Firm* — Elliott Law PLLC; Douglas H. Elliott; Nathan Q. Huynh

(57) ABSTRACT

Disclosed herein are methods of smoking combustible material(s) including methods that may include: providing any of the smoking assemblies disclosed herein, and utilizing such smoking assemblies for smoking, wherein such smoking assemblies may each include, for example: a housing that may include an intake aperture and an exhaust aperture; a fan disposed inside the housing; and a valve coupled to the housing, inside the housing; moving air in the housing and out through the exhaust aperture, preferably utilizing the circular movement of the fan; and partially or fully inhibiting air flow from the intake aperture to the exhaust aperture, preferably using the valve, e.g., by partially closing and/or opening the fan.

1 Claim, 8 Drawing Sheets

SMOKING ASSEMBLIES AND METHODS OF SMOKING

BACKGROUND

1. Field of Inventions

The field of this application and any resulting patent is smoking assemblies and methods of smoking.

2. Description of Related Art

Various smoking assemblies and methods for using smoking assemblies have been proposed and utilized, including some assemblies and methods disclosed in the prior art references listed in this patent. However, those assemblies and methods lack the combination of features and/or steps of the assemblies and/or methods disclosed and claimed herein. Furthermore, it is contemplated that the assemblies and methods disclosed and claimed herein solve at least certain problems that prior art assemblies and methods have failed to solve.

SUMMARY

Disclosed herein are methods of smoking combustible material(s) including methods that may include: providing any of the smoking assemblies disclosed herein, and utilizing such smoking assemblies for smoking, wherein such smoking assemblies may each include, for example: a housing that may include an intake aperture and an exhaust aperture; a fan disposed inside the housing; and a valve coupled to the housing, inside the housing; moving air in the housing and out through the exhaust aperture, preferably utilizing the circular movement of the fan; and partially or fully inhibiting air flow from the intake aperture to the exhaust aperture, preferably using the valve, e.g., by partially closing and/or opening the fan.

Also disclosed herein are methods of smoking combustible material(s) including a method that may include: providing a smoking assembly that may include: a first housing portion having an intake aperture; and a second housing portion having an exhaust aperture; a fan; and a valve disposed in either the first housing portion or the second housing portion, or both; moving, preferably with the fan, air in the first housing portion out through the exhaust aperture; and partially or fully inhibiting, preferably with the valve, air flow from the intake aperture to the exhaust aperture.

Also, disclosed herein are smoking assemblies that may include: a housing that may include an intake aperture and an exhaust aperture; a fan that may be disposed inside the housing and capable of moving air from inside the housing out through the exhaust aperture; and a valve that may be coupled to the housing and may be capable of partially or fully inhibiting air flow from the intake aperture to the exhaust aperture.

Additionally, disclosed herein are smoking assemblies that may include: a housing that may include an intake aperture and an exhaust aperture; a fan that may be disposed inside the housing and may be capable of moving air from inside the housing to outside the housing through the exhaust aperture; a first valve that may be disposed between the intake aperture and the fan; and a second valve that may be disposed between the fan and the exhaust aperture.

Also, disclosed herein are smoking assemblies that may include: a housing that may include: a housing that may include: a first housing portion that may have an intake aperture; and a second housing portion that may have an exhaust aperture; a fan that may be capable of moving air in the first housing portion out through the exhaust aperture; and a valve that may be disposed in either the first housing portion or the second housing portion, or both, wherein the valve is preferably capable of partially or fully inhibiting air flow from the intake aperture to the exhaust aperture.

Further, disclosed herein are smoking assemblies that may include: a housing that may include: a first housing portion that may have an intake aperture; and a second housing portion that may have an exhaust aperture; a fan capable of moving air in the first housing portion out through the exhaust aperture; a first valve that may be disposed in the first housing portion and capable of partially or fully inhibiting air flow from the intake aperture to the fan; and a second valve that may be disposed in the second housing portion and may be capable of partially or fully inhibiting air flow from the fan to the exhaust aperture.

A smoking assembly, comprising a housing having: an interior space, an upper end, a lower end, and side walls extending between the upper end and the lower end; a fan disposed in the interior space between the upper end and the lower end; two or more exhaust vents in the side walls of the housing, wherein the distance from each of the two or more exhaust vents to the upper end of the housing is greater than the distance from each of the two or more exhaust vents to the lower end of the housing; and a valve disposed in the interior space between the fan and the two or more exhaust vents, wherein the valve is capable of being adjusted from a closed position to an open position and vice versa.

DETAILED DESCRIPTION

1. Introduction

Figure 1A:
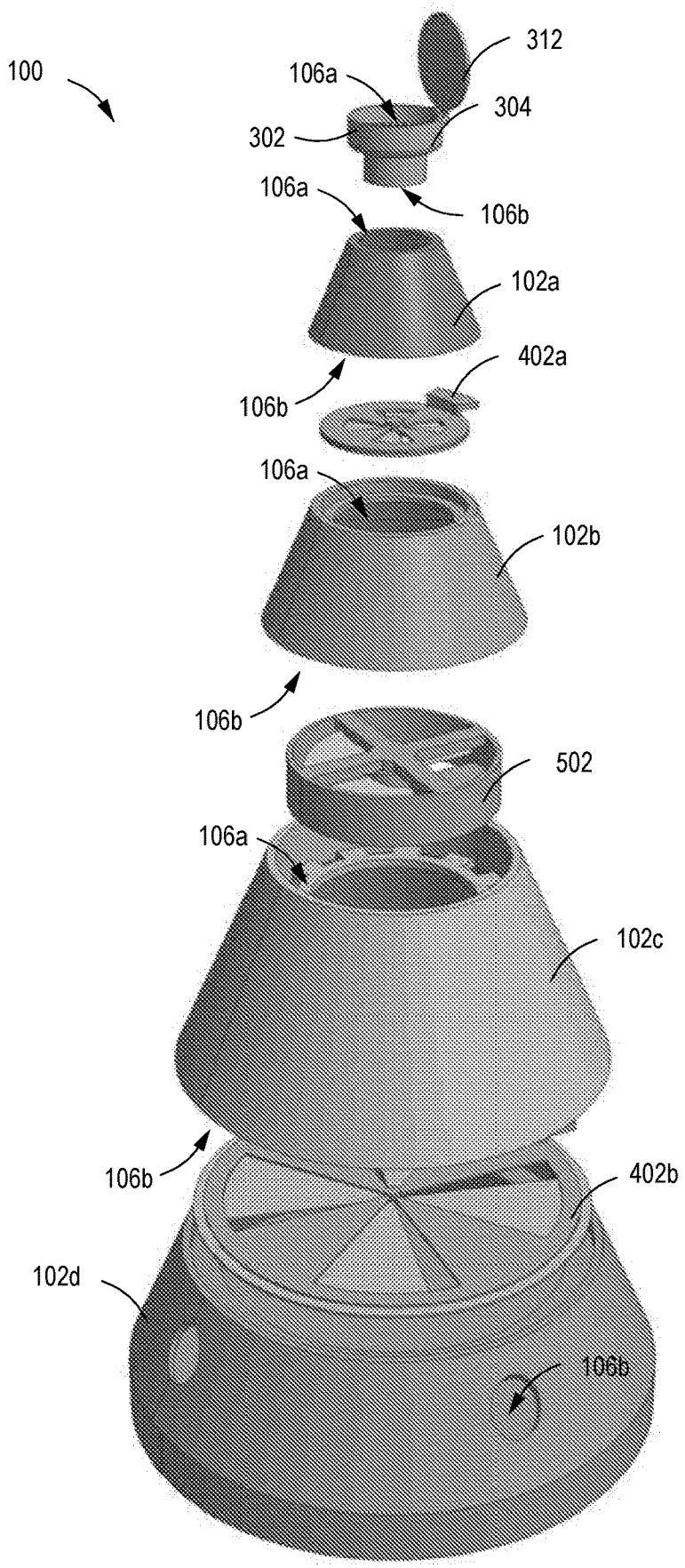
FIG. 1A illustrates a perspective exploded view of a smoking assembly.

A detailed description will now be provided. The purpose of this detailed description, which includes the drawings, is to satisfy the statutory requirements of 35 U.S.C. § 112. For example, the detailed description includes a description of inventions defined by the claims and sufficient information that would enable a person having ordinary skill in the art to make and use the inventions. In the figures, like elements are generally indicated by like reference numerals regardless of the view or figure in which the elements appear. The figures are intended to assist the description and to provide a visual representation of certain aspects of the subject matter described herein. The figures are not all necessarily drawn to scale, nor do they show all the structural details, nor do they limit the scope of the claims.

Each of the appended claims defines a separate invention which, for infringement purposes, is recognized as including equivalents of the various elements or limitations specified in the claims. Depending on the context, all references below to the "invention" may in some cases refer to certain specific embodiments only. In other cases, it will be recognized that references to the "invention" will refer to the subject matter recited in one or more, but not necessarily all, of the claims. Each of the inventions will now be described in greater detail below, including specific embodiments, versions, and examples, but the inventions are not limited to these specific embodiments, versions, or examples, which are included to enable a person having ordinary skill in the art to make and use the inventions when the information in this patent is combined with available information and technology. Various terms as used herein are defined below, and the definitions should be adopted when construing the claims that include those terms, except to the extent a different meaning is given within the specification or in express representations to the Patent and Trademark Office (PTO). To the extent a term used in a claim is not defined below or in representations to the PTO, it should be given the broadest definition persons having skill in the art have given that term as reflected in at least one printed publication, dictionary, or issued patent.

2. Selected Definitions

Certain claims include one or more of the following terms which, as used herein, are expressly defined below.

The term "adjacent" as used herein means next to and may include physical contact but does not require physical contact.

The term "abut against" as used herein as a verb is defined as position adjacent to and either physically touch or press against, directly or indirectly. After any abutting takes place with one object relative to another object, the objects may be fully or partially "abutted." A first object may be abutted against a second object such that the second object is limited from moving in a direction of the first object. For example, a first housing portion may be abutted against a second housing portion.

The term "aligning" as used herein is a verb that means manufacturing, forming, adjusting, or arranging one or more physical objects into a particular position. After any aligning takes place, the objects may be fully or partially "aligned." Aligning preferably involves arranging a structure or surface of a structure in linear relation to another structure or surface; for example, such that their borders or perimeters may share a set of parallel tangential lines. In certain instances, the aligned borders or perimeters may share a similar profile. Additionally, apertures may be aligned, such that a structure or portion of a structure may be extended into and/or through the apertures.

The term "aperture" as used herein is defined as any opening in a solid surface or object including a structure such as a housing and/or a housing portion. For example, an aperture may be a three-dimensional opening that begins on one side of a solid object and ends on the other side of the object, e.g., the space inside a housing, or an aperture passing through a housing wall. An aperture may alternatively be an opening that does not pass entirely through an object, but only partially passes through, e.g., as a groove. An aperture can be an opening in an object that is completely circumscribed, defined, or delimited by the object itself. Alternatively, an aperture can be an opening formed when one object is combined with one or more other objects or structures. An aperture may receive an object, e.g., portion of a housing, a valve, or a fan.

The term "bowl" as used as a noun herein is defined as any fully solid or partially solid structure configured, sized, and/or shaped for supporting combustible material, e.g., cannabis, preferably a structure that has wall(s) such that an interior portion is capable of holding the combustible material, as exemplified in the drawings, and such bowl may be cylindrical or include a curved inner surface, e.g., having a concave inner surface. A bowl may include a portion having a cross-section that is cylindrical or rectangular or some other geometric shape. A bowl may have an end portion extended into a housing portion. A bowl may have an aperture extending axially therethrough. A bowl may have a receptacle for receiving combustible material.

The term "assembly" as used herein is defined as any set of components that have been fully or partially assembled together. A group of assemblies may be coupled to form a larger assembly.

The term "coupled" as used herein is defined as directly or indirectly connected or attached. A first object may be coupled to a second object such that the first object is positioned at a specific location and orientation with respect to the second object. For example, a motor may be coupled to a cutter assembly. A first object may be either permanently, removably, slidably, rotatably, and/or electrically coupled to a second object. Two objects are "permanently coupled," if once they are coupled, the two objects, in some cases, cannot be separated. Two objects may be "removably coupled" to each other via shear pins, threads, tape, latches, hooks, fasteners, locks, male and female connectors, clips, clamps, knots, and/or surface-to-surface contact. For example, a first housing portion and a second housing portion may be removably coupled to each other such that the first housing portion may then be uncoupled and removed from the second housing portion. Two objects may be "slidably coupled" where an inner aperture of one object is capable of receiving a second object. For example, first valve plate may be slidably coupled to a second valve plate, such that a surface of the first valve plate is capable of being slid across a surface of the second valve plate. Two objects may be capable of being "rotatably coupled," e.g., where one object is capable of being rotated, swiveled, and/or pivoted relative to the other object. For example, a first valve plate may be rotatably coupled to a second valve plate, such that the first valve plate is capable of being rotated relative to the second valve plate. Two objects may be capable of being "electrically coupled," e.g., where electricity may be conducted from one object to another object. For example, a fan may be electrically coupled to an electrical motor via wires even though the fan is not in physical contact with the electrical motor itself.

The term "cylindrical" as used herein is defined as shaped like a cylinder, e.g., having a fully or partially circular or oval or elliptical cross-section. Preferably any cylindrical structure herein, e.g., a housing, has either straight parallel sides or has a frustroconical shape such that the sides are not parallel but rather are tapered as show in the housing in at least FIGS. 1 and 2. Examples of a cylindrical structure or object may include a housing, a housing portion, and a valve. A cylindrical object may be completely or partially shaped like a cylinder. For example, a cylindrical object may have an aperture that is extended through the entire length of the housing to form a hollow cylinder capable of permitting another object, e.g., a stem portion of a bowl, a filter, a valve, or a fan, to be disposed or extended in or through. Alternatively, a solid cylindrical object may have an inner surface or outer surface having a diameter that changes abruptly. A cylindrical object may have and inner or outer surface having a diameter that changes abruptly to form a flange, e.g., collar, radial face, rim, or lip. A cylindrical object may have a flange extending toward or away from the central axis line of the object. A cylindrical object may have a flange disposed on an inner surface. A cylindrical object may have a flange disposed on an outer surface. Additionally, a cylindrical object, may have a flange that is tapered or radiused.

The terms "first" and "second" as used herein merely differentiate two or more things or actions, and do not signify anything else, including order of importance, sequence, etc.

The term "flap" includes any solid structure that when disposed next to or within an aperture can be configured in various positions including an open position so that the aperture is open and a closed position so that the aperture is closed. As illustrated in the exemplary drawings herein, a bowl may have an aperture with a rigid flap that swings or rotates between open and closed positions.

The term "fluid" as used herein is defined as material that is capable of flowing. A fluid may be a liquid or a gas, e.g., water, air, oxygen, carbon, nitrogen. A fluid may include particles, e.g., water droplets, smoke, ash, debris, compounds, and/or elements. A fluid can be a mixture of two or more fluids. A fluid may absorb heat.

The term "housing" as used herein is defined as any fully solid or partially solid structure that can receive objects or structures and has walls and space inside with room for some other structure, preferably multiple structures including a portion of a bowl, a filter, a valve, a fan, and other components as shown in the drawings herein. A housing is preferably hollow. A housing may be formed from two or more housing portions (see 102*a-d*, FIGS. 1A-B). A housing and/or a housing portion may have apertures, e.g., intake apertures and/or exhaust apertures, extending therethrough.

The term "perpendicular" as used herein is defined as at an angle ranging from 85° or 88 to 92° or 95°. Two structures that are perpendicular to each other may be orthogonal and/or tangential to each other.

The term "providing" as used herein is defined as making available, furnishing, supplying, equipping, or causing to be placed in position.

The term "surface" as used herein is defined as any face and/or boundary of a structure. A surface may also refer to that flat or substantially flat area that is extended across a flat structure which may, for example, be part of a valve plate. A surface may also refer to any curved area that extends circumferentially around a cylindrical structure or object which may, for example, be part of a housing and/or housing portion. A surface may have irregular contours. A surface may be formed from coupled components, e.g. a housing portion, a bowl, a valve, and/or a fan. Coupled components may form irregular surfaces. A plurality of surfaces may be connected to form a polygonal cross-section. An example of a polygonal cross-section may be triangular, square, rectangular, pentagonal, hexagonal, or octagonal.

The term "tapered" as used herein is defined as becoming progressively smaller at one end. Structures that are tapered may have a profile that is beveled, frustoconical, and/or conical.

The term "threaded" as used herein is defined as having threads. Threads may include one or more helical protrusions or grooves on a surface of a cylindrical object. Each full rotation of a protrusion or groove around a threaded surface of the object is referred to herein as a single "thread." Threads may be disposed on any cylindrical structure or object including a housing portion. Threads formed on an inner surface of an object, e.g., housing, may be referred to as "box threads". Threads formed on an outer surface of an object, e.g., housing, may be referred to as "pin threads." A threaded assembly may include a "threaded portion" wherein a section of the threaded assembly includes threads, e.g., pin threads or box threads. A threaded portion may have a diameter sized to extend through an aperture of a housing portion or a collar. In certain cases, a threaded portion of a first object may be removably coupled to a threaded portion of a second object.

The term "unitary" as used herein defined as having the form of a single unit.

The terms "upper," "lower," "top," "bottom" as used herein are relative terms describing the position of one object, thing, or point positioned in its intended useful position, relative to some other object, thing, or point also positioned in its intended useful position, when the objects, things, or points are compared to distance from the center of the earth. The term "upper" or "top" identifies any object or part of a particular object that is farther away from the center of the earth than some other object or part of that particular object, when the objects are positioned in their intended useful positions. The term "lower" or "bottom" identifies any object or part of a particular object that is closer to the center of the earth than some other object or part of that particular object, when the objects are positioned in their intended useful positions.

The term "valve" as used herein is defined as any structure or assembly capable of preventing the passage of air and/or smoke from one side of the structure to the other side of the structure, e.g., in a fully closed position. A valve may be configured, sized, and/or shaped to, partially or fully, inhibit flow of fluid, e.g. air and/or smoke. Preferably, a valve has an aperture configured so that it can be opened or closed, e.g., can be adjusted from a fully or partially open position to a fully closed position (since a partially closed position will be a partially open position). A valve may include a first valve plate and a second valve plate rotatably coupled to first valve plate. A valve plate may have a protrusion, e.g., handle, extending through a housing.

3. Certain Specific Embodiments

Disclosed herein are methods of smoking combustible material(s) including methods that may include: providing any of the smoking assemblies disclosed herein, and utilizing such smoking assemblies for smoking, wherein such smoking assemblies may each include, for example: a housing that may include an intake aperture and an exhaust aperture; a fan disposed inside the housing; and a valve coupled to the housing, inside the housing; moving air in the housing and out through the exhaust aperture, preferably utilizing the circular movement of the fan; and partially or fully inhibiting air flow from the intake aperture to the exhaust aperture, preferably using the valve, e.g., by partially closing and/or opening the fan.

Also disclosed herein are methods of smoking combustible material(s) including a method that may include: providing a smoking assembly that may include: a first housing portion having an intake aperture; and a second housing portion having an exhaust aperture; a fan; and a valve disposed in either the first housing portion or the second housing portion, or both; moving, preferably with the fan, air in the first housing portion out through the exhaust aperture; and partially or fully inhibiting, preferably with the valve, air flow from the intake aperture to the exhaust aperture.

Also, disclosed herein are smoking assemblies that may include: a housing that may include an intake aperture and an exhaust aperture; a fan that may be disposed inside the housing and capable of moving air from inside the housing out through the exhaust aperture; and a valve that may be coupled to the housing and may be capable of partially or fully inhibiting air flow from the intake aperture to the exhaust aperture.

Additionally, disclosed herein are smoking assemblies that may include: a housing that may include an intake aperture and an exhaust aperture; a fan that may be disposed inside the housing and may be capable of moving air from inside the housing to outside the housing through the exhaust aperture; a first valve that may be disposed between the intake aperture and the fan; and a second valve that may be disposed between the fan and the exhaust aperture.

Also, disclosed herein are smoking assemblies that may include: a housing that may include: a housing that may include: a first housing portion that may have an intake aperture; and a second housing portion that may have an exhaust aperture; a fan that may be capable of moving air in the first housing portion out through the exhaust aperture; and a valve that may be disposed in either the first housing portion or the second housing portion, or both, wherein the valve is preferably capable of partially or fully inhibiting air flow from the intake aperture to the exhaust aperture.

Further, disclosed herein are smoking assemblies that may include: a housing that may include: a first housing portion that may have an intake aperture; and a second housing portion that may have an exhaust aperture; a fan capable of moving air in the first housing portion out through the exhaust aperture; a first valve that may be disposed in the first housing portion and capable of partially or fully inhibiting air flow from the intake aperture to the fan; and a second valve that may be disposed in the second housing portion and may be capable of partially or fully inhibiting air flow from the fan to the exhaust aperture.

A smoking assembly, comprising a housing having: an interior space, an upper end, a lower end, and side walls extending between the upper end and the lower end; a fan disposed in the interior space between the upper end and the lower end; two or more exhaust vents in the side walls of the housing, wherein the distance from each of the two or more exhaust vents to the upper end of the housing is greater than the distance from each of the two or more exhaust vents to the lower end of the housing; and a valve disposed in the interior space between the fan and the two or more exhaust vents, wherein the valve is capable of being adjusted from a closed position to an open position and vice versa.

In any one of the methods or assemblies disclosed herein, the fourth housing may have a flange having apertures extending therethrough.

In any one of the methods or assemblies disclosed herein, the fourth housing may have a flange having apertures extending therethrough, wherein the apertures may surround the fan.

In any one of the methods or assemblies disclosed herein, the housing may be frustoconical.

In any one of the methods or assemblies disclosed herein, the fan may be disposed between the intake aperture and the exhaust aperture.

In any one of the methods or assemblies disclosed herein, the fan may be coupled to an inner surface of the housing.

In any one of the methods or assemblies disclosed herein, the fan may be rotatably coupled to the housing.

In any one of the methods or assemblies disclosed herein, the valve may be in the second housing portion.

In any one of the methods or assemblies disclosed herein, the valve may be disposed between the first housing portion and the second housing portion.

In any one of the methods or assemblies disclosed herein, the valve may be in the fourth housing portion.

In any one of the methods or assemblies disclosed herein, the valve may be disposed between the third housing portion and the fourth housing portion.

In any one of the methods or assemblies disclosed herein, the valve may be disposed above the fan.

In any one of the methods or assemblies disclosed herein, the valve may be disposed below the fan.

In any one of the methods or assemblies disclosed herein, the valve may be disposed above the exhaust valve.

In any one of the methods or assemblies disclosed herein, the fan may be disposed between the first valve and the second valve.

In any one of the methods or assemblies disclosed herein, the fan may be disposed in the second valve.

In any one of the methods or assemblies disclosed herein, the first valve may be capable of partially or fully inhibiting air flow from the intake aperture to the fan.

In any one of the methods or assemblies disclosed herein, the first valve may be disposed above the fan.

In any one of the methods or assemblies disclosed herein, the first valve may be disposed below the intake apertures.

In any one of the methods or assemblies disclosed herein, the first valve may be disposed above the exhaust valve.

In any one of the methods or assemblies disclosed herein, the fan may be disposed between the first valve and the second valve.

In any one of the methods or assemblies disclosed herein, the fan may be disposed in the second valve.

In any one of the methods or assemblies disclosed herein, the second valve may be capable of partially or fully inhibiting air flow from the fan to the intake aperture.

In any one of the methods or assemblies disclosed herein, the second valve may be disposed between the fan and the exhaust apertures.

In any one of the methods or assemblies disclosed herein, the second valve may be disposed below the fan.

In any one of the methods or assemblies disclosed herein, the second valve may be disposed below the intake apertures.

In any one of the methods or assemblies disclosed herein, the second valve may be disposed above the exhaust valve.

In any one of the methods or assemblies disclosed herein, the first housing portion has a diameter smaller than a diameter of the second housing portion.

In any one of the methods or assemblies disclosed herein, the housing may further include a base.

In any one of the methods or assemblies disclosed herein, the second housing portion, the third housing portion, and the fourth housing portion are electrically coupled.

4. Specific Embodiments in the Drawings

The drawings presented herein are for illustrative purposes only and do not limit the scope of the disclosure. Rather, the drawings are intended to help enable one having ordinary skill in the art to make and use the assemblies disclosed herein.

This section addresses specific versions of smoking assemblies shown in the drawings, which relate to assemblies, elements and parts that can be part of a smoking assembly. Although this section focuses on the drawings herein, and the specific embodiments found in those drawings, parts of this section may also have applicability to other embodiments not shown in the drawings. The limitations referenced in this section should not be used to limit the scope of the claims themselves, which have broader applicability.

Figure 1B:
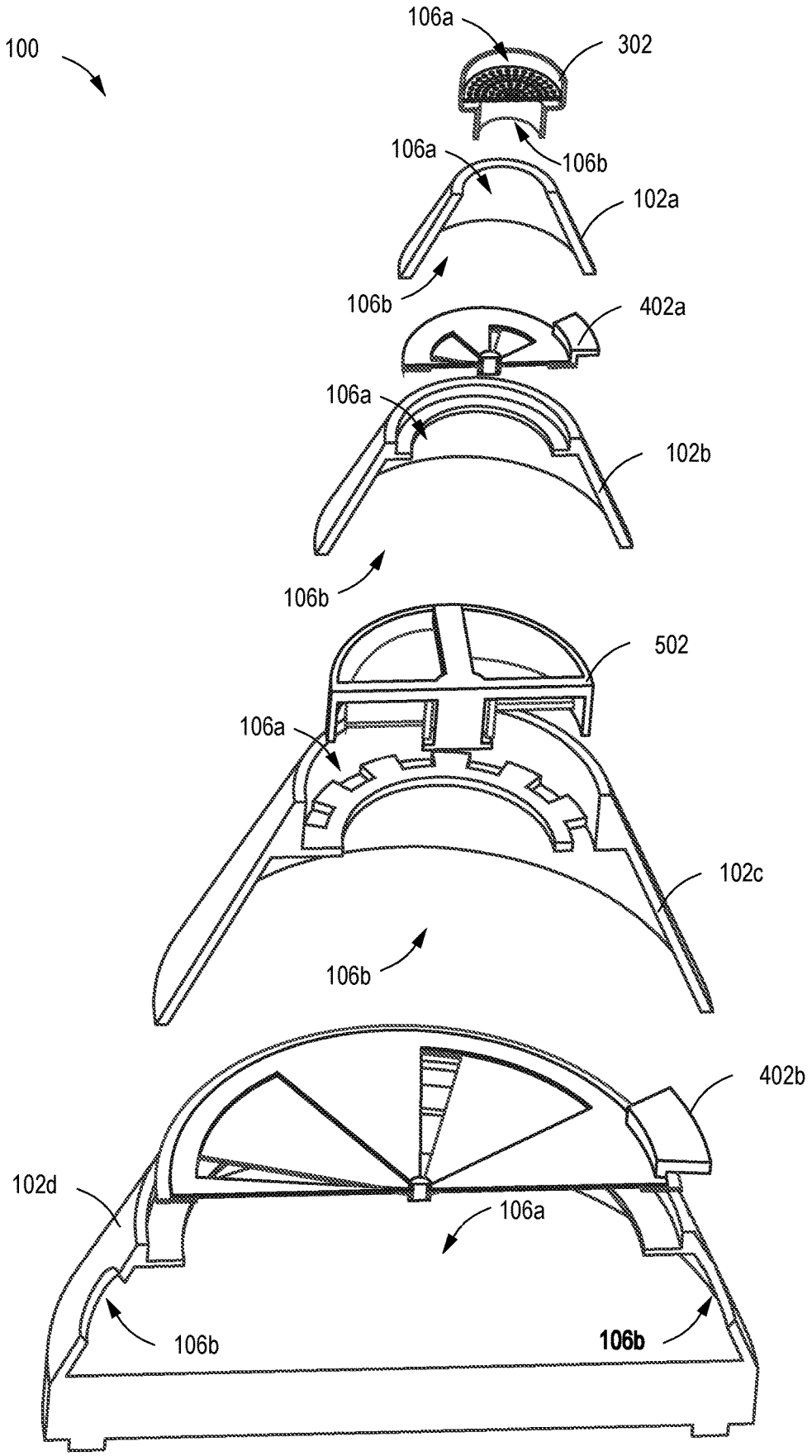
FIG. 1B illustrates a cross-sectional exploded view of a smoking assembly.
Figure 2:
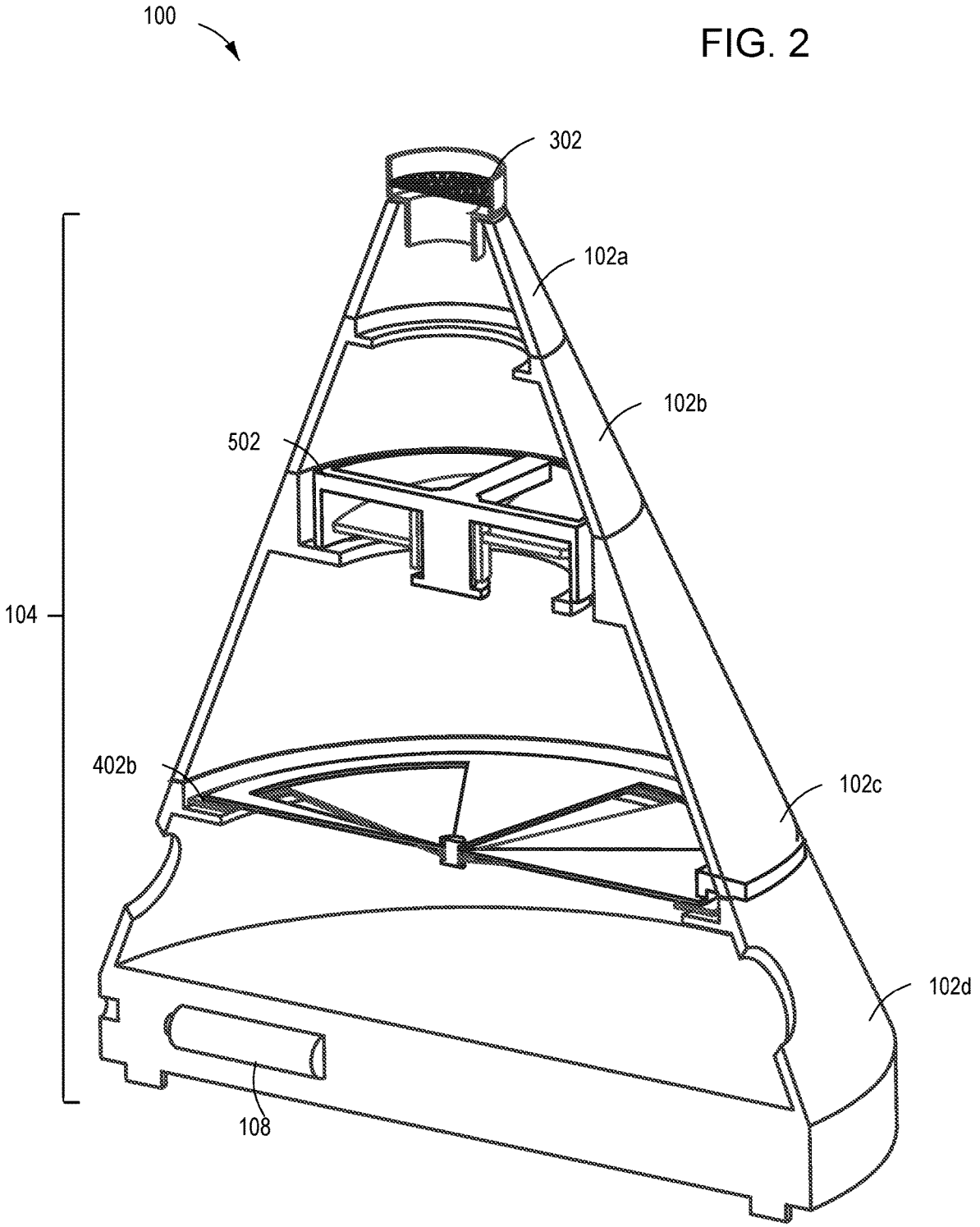
FIG. 2 illustrates a cross-sectional perspective view of an assembled smoking assembly.

FIG. 1A illustrates a perspective exploded view of a smoking assembly 100. FIG. 1B illustrates a cross-sectional exploded view of a smoking assembly. FIG. 2 illustrates a cross-section perspective view of an assembled smoking assembly 100.

Referring to FIGS. 1A-C and FIG. 2, a smoking assembly 100 includes two or more housing portions that can be coupled together to form a housing 104. For example, individual housing portions can be coupled to an adjoining housing portion to form a housing, e.g., a first housing portion 102*a*, a second housing portion 102*b*, a third housing portion 102*c*, and fourth housing portion 102*d*. From top to bottom, the housing portions 102*a-d* may be removably coupled in order of size, e.g., smallest to largest.

Figure 1C:
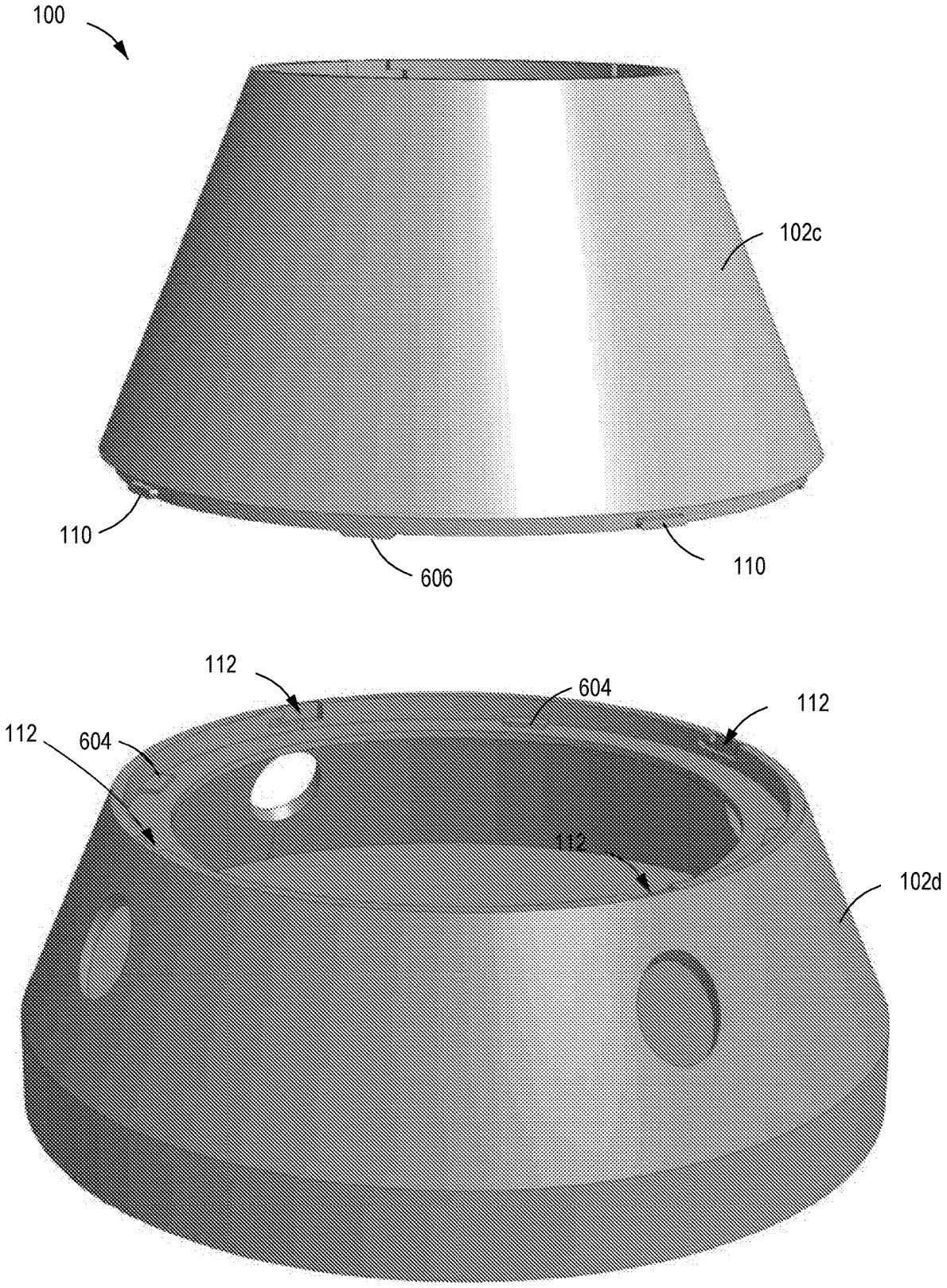
FIG. 1C illustrates knobs of a third hosing portion and slots of a fourth housing portion.

As shown in FIG. 1C, for any pair of housing portions capable of being coupled together, an upper housing portion 102*c* of the pair of housing portions has one or more knobs 110 disposed at a lower end of the housing portion 102*c*. The one or more knobs 110 may extend radially from the lower end of the housing portion 102*c*.

The one or more knobs 110 may be received in one or more respective one or more slots 112 disposed in a lower housing portion 102*d* of the pair of housing portions. The one or more slots 112 disposed at an upper end of the housing portion 102*d*. The one or more slots 112 may have the shape of a block letter L or J.

Disposing the one or more knobs 110 into the respective one or more slots 112 and rotating, e.g., clockwise or counterclockwise, the one or more knobs 110 relative to the one or more slots 112 would couple the upper housing portion 102*c* to the lower housing portion 102*d*. Reverse the rotation of the one or more knobs 110 would allow a user to uncouple the upper housing portion 102*c* and the lower housing portion 102*d*.

Accordingly, referring to FIGS. 1A and 2, the first housing portion 102*a* is removably coupled to the second housing portion 102*b*. The second housing portion 102*b* is removably coupled to the third housing portion 102*c*. The third housing portion 102*c* is removably coupled to the fourth housing portion 102*d*. Assembled, the housing portions 102*a-d* may form a housing 104. The housing 104 has a frusto-conical shape.

Figure 3:
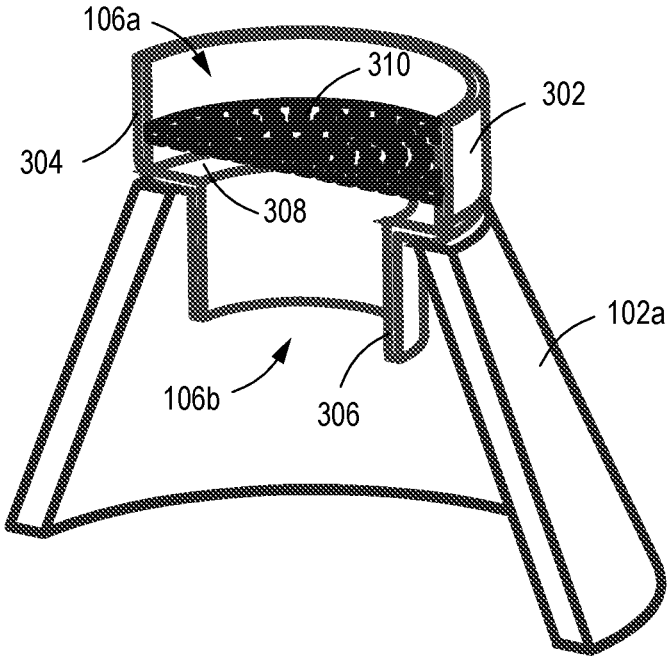
FIG. 3 illustrates a cross-sectional perspective view of a bowl coupled to a housing portion.

Each of the multiple housing portions 102*a-d* in FIGS. 1-3 is cylindrical, and more specifically each is frusto-conical, having an inner surface and an outer surface. Each housing portion has side walls that define an interior space, and at least two openings, which may be referred to herein as apertures 106*a*, 106*b*. In the specific assembly in FIGS. 1-3, the uppermost housing portion 102*a* has an upper intake aperture 106*a* and a lower exhaust aperture 106*b*, wherein the term "intake" refers to the fact that when the fan is operated as described herein, air enters each of the housing portions (e.g., sections) in sequential fashion, flowing in a downward direction parallel with the invisible axis running through the center of the housing. After passing through each of the housing portions the air then exits that particular housing portion through an opening at the bottom, that is referred to in certain instances herein as an "exhaust" aperture. Each housing portion 102*a-c* has an intake aperture 106*a* and at least one exhaust aperture 106*b* each aligned with the central axis. The fourth housing portion 102*d* has an intake aperture 106*a* also axially aligned with the central axis, but in the fourth housing portion, each of the exhaust apertures 106*b* is disposed in the side walls of the housing portion at a point between the lower end of the housing, e.g., the lower end of the lowest housing portion, and the upper end of the housing, e.g., the upper end of the housing portion.

Additionally, the fourth housing portion 102*d* includes a base. The base has a compartment for storage of a power supply 108, e.g., battery. The power supply may be rechargeable.

Air entering any of the intake apertures 106*a* exits through an exhaust aperture 106*b* of each of the housing portions 102*a-d*. Thus, when each of the housing portions 102*a-d* is coupled to an adjoining housing portion, air entering the intake aperture 106*a* of the first housing portion 102*a* could be pushed downward, e.g., via a fan 502, to exit through the one or more exhaust apertures 106*b* of the fourth housing portion 102*d*.

Figure 4:
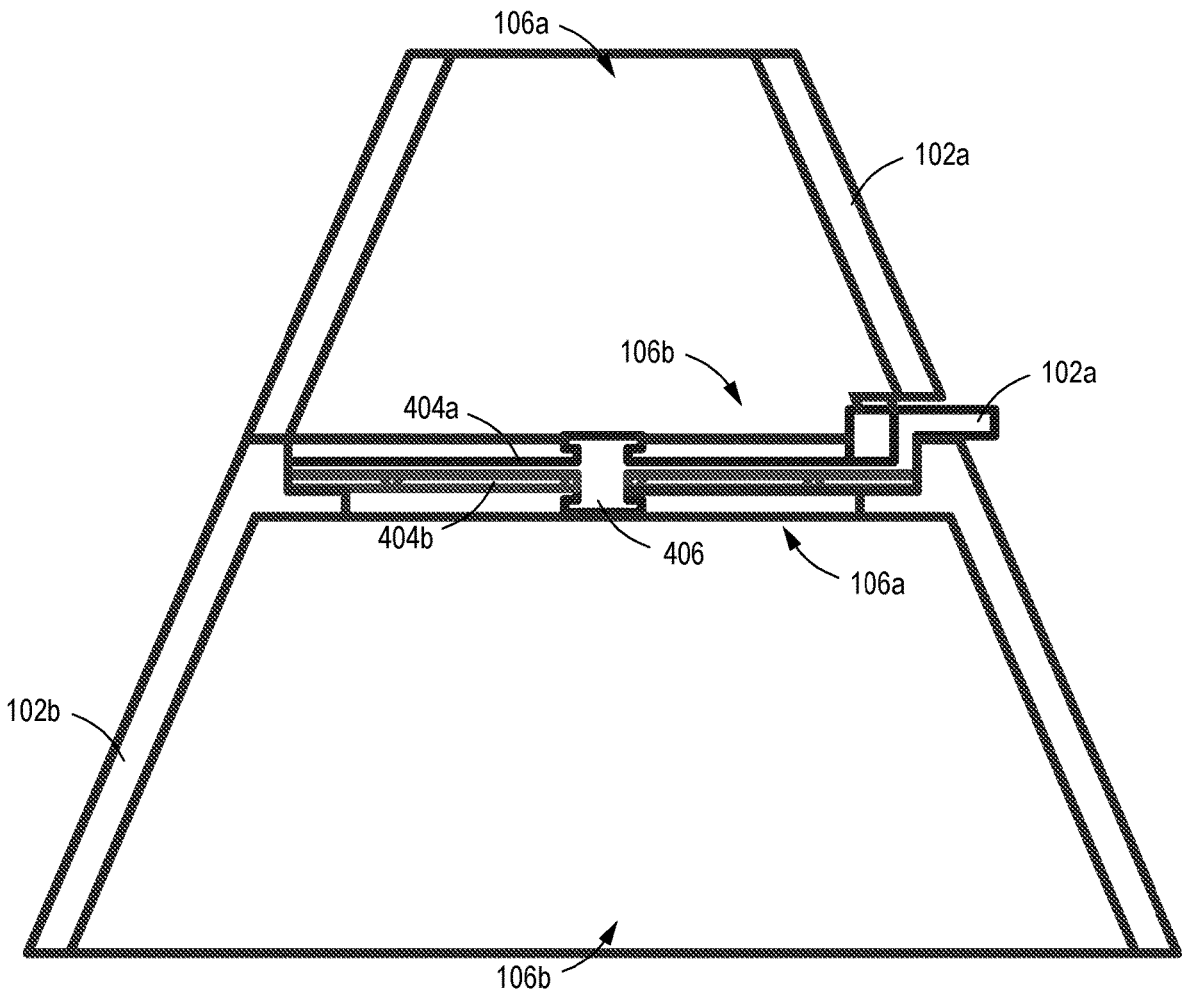
FIG. 4 illustrates a cross-sectional view of a valve disposed in a housing portion.
Figure 5:
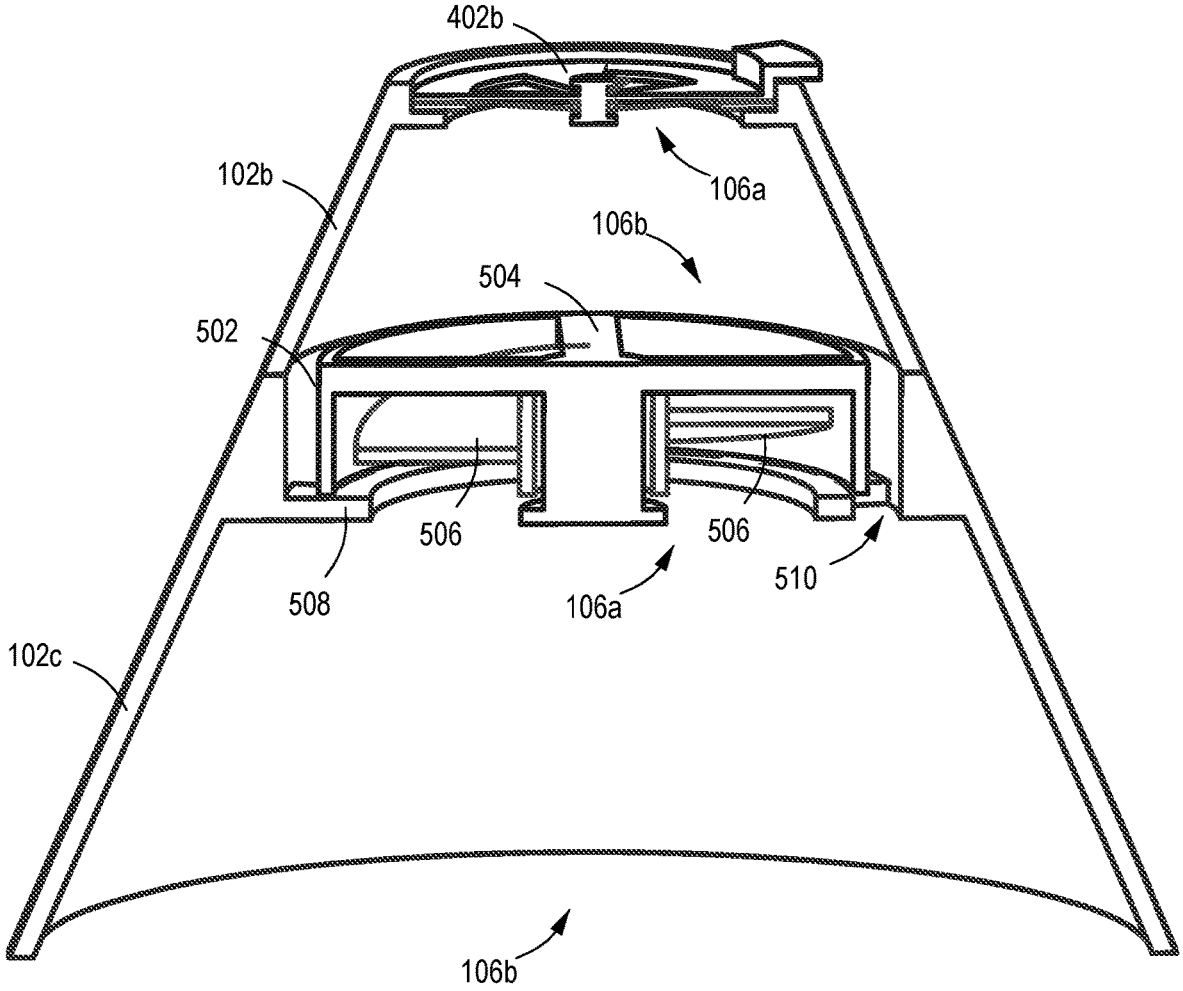
FIG. 5 illustrates a cross-sectional perspective view of a fan disposed in a housing portion.

Additionally, the smoking assembly 100 may include a bowl 302, a fan 502, and two or more valves, e.g., a first valve 402*a* and a second valve 402*b*. The bowl 302 may be removably coupled to the first housing portion 102*a*. The first valve 402*a* may be disposed in the second housing portion 102*b*. The fan 502 may be disposed in the third housing portion 102*c*. The second valve 402*b* may be disposed in the third housing portion 102*d*. FIGS. 3-5 provide close-up perspective cross-sectional views of those components for better illustration.

Referring to FIG. 3, a bowl 302 is a cylinder having a receptacle portion 304 and stem portion 306. The receptacle portion 304 has an intake aperture 106*a* disposed therein. The stem portion 306 has an exhaust aperture 106*b* disposed therein. The intake aperture 106*a* and the exhaust aperture 106*b* are in fluid communication. The surfaces defining the intake aperture 106*a* and the exhaust aperture 106*b* have different diameters. Accordingly, the bowl 302 has a flange 308 where the aperture 106 transitions to the exhaust aperture 106*b*.

A filter 310 is disposed on the flange 308, in the intake aperture 106*a*. The flange 308 may include a ledge with a surface facing upward, which is circumferential, and is disposed around the interior wall of the housing as shown in FIG. 3. Similarly, as noted below, certain of the other housing portions include flanges with ledges similar upwardly-facing surfaces. Combustible material may be disposed in the intake aperture 102*a*, on the filter 310. Although, the filter 310 may have small holes disposed therethrough, in some cases, the holes are relatively small that debris or particles from the combustible material may be inhibited from falling through the filter 310. However, air may still be drawn through the holes in the filter 310.

Additionally, a lid 312 is rotatably coupled to the receptacle portion 304 of the bowl 302 (see FIG. 1A). A pin (not shown) extends through portions of the lid 312 and the receptacle portion 304. The lid 312 is capable rotating on an axis of the pin. The lid 312 may be swung or rotated to cover the intake aperture 106*a* of the bowl 302.

Referring to FIG. 4, each of the valves may include two or more plates with flat surfaces that are coplanar to each other, wherein at least one of the valve plates is rotatable around an axis that is common to both valve plates, such that in at least one position, e.g., a partially or fully "open position," the valve includes an open aperture, and in another position, e.g., a closed position, the valve does not include an aperture or, alternatively stated, includes aperture that is closed. In that structure, more specifically, valve 402 may include a first valve plate 404*a* and a second valve plate 404*b*. The valve plates 404*a*, 404*b* have planar surfaces. The lower surface of the valve plate 404*a* may be disposed on the upper surface of the valve plate 404*b*. A pin 406 may extend through the valve plates 404*a*, 404*b*. Accordingly, the valve plates 404*a*, 404*b* are slidably and/or rotatably coupled to each other.

The valve plates 404*a*, 404*b* are configured, sized, and/or shaped to be disposed in an aperture of a housing portion, e.g., housing portion 102*b* or housing portion 102*d*.

Additionally, the second plate 404*b* may include a handle 406 extending therefrom. The handle 406 has a first handle portion extending parallel to a central axis of the second valve plate 404*b*. The handle 406 also has second handle portion extending (from the first portion) perpendicular to the first portion. Moreover, when disposed in an aperture of a housing portion 102, the second handle portion extends across a cross-section of a wall of the housing portion 102.

As shown, in the FIG. 5, valves 402*a*, 402*b* may be disposed in intake apertures 106*a* of a second housing portion 102*b* and a fourth housing portion 102*d*, respectively.

FIG. 5 illustrates a cross-sectional view of a fan 502 disposed in a third housing portion 102*c*. The fan 502 includes a frame 504 and blades 506. The blades 506 may be coupled to an electrical motor (not shown). The motor may be coupled to the frame 504. Additionally, the motor may be electrically coupled, e.g., conductive wires, to a power supply 108 disposed in a base of another housing portion (see 102*d*, FIG. 2).

The fan 502 may be disposed in an aperture 106 of a housing portion 102. The fan 502 is disposed on a flange 508. The flange 508 extends inwardly from an inner surface of the housing portion 102.

The flange 508 has apertures 510 extending therethrough. The apertures 510 are positioned through the flange 508 so that when the fan 502 is disposed thereon, the apertures 510 surrounds the fan 502.

The apertures 510 are beneficial for efficient circulation of air in a smoking assembly 100 and for operation of the fan 502. Referring to FIGS. 2 and 5, when running, the fan 502 draws air from above and pushes the air downward. Normally, the downward moving air would exit exhaust apertures 106*b* in a fourth housing portion 102*d*. However, if a valve 402*b* (disposed in the fourth housing portion 102*d*) were closed, the air would be forced upwards back towards the fan 502. The upward-moving air would interfere with air the fan 502 is blowing down. The interference may cause the fan 502 to become unstable, overheat, and/or stall.

However, the apertures 510 provides outlets for the upward-moving air to move past the downward-moving air. Moreover, the upward-moving air would move past the fan 502 (through the apertures 510) and cycle through the fan 502 again. Thus, if the smoke assembly 100 were to be completely closed, the apertures 510 would allow the fan 502 to operated unimpeded.

Figure 6:
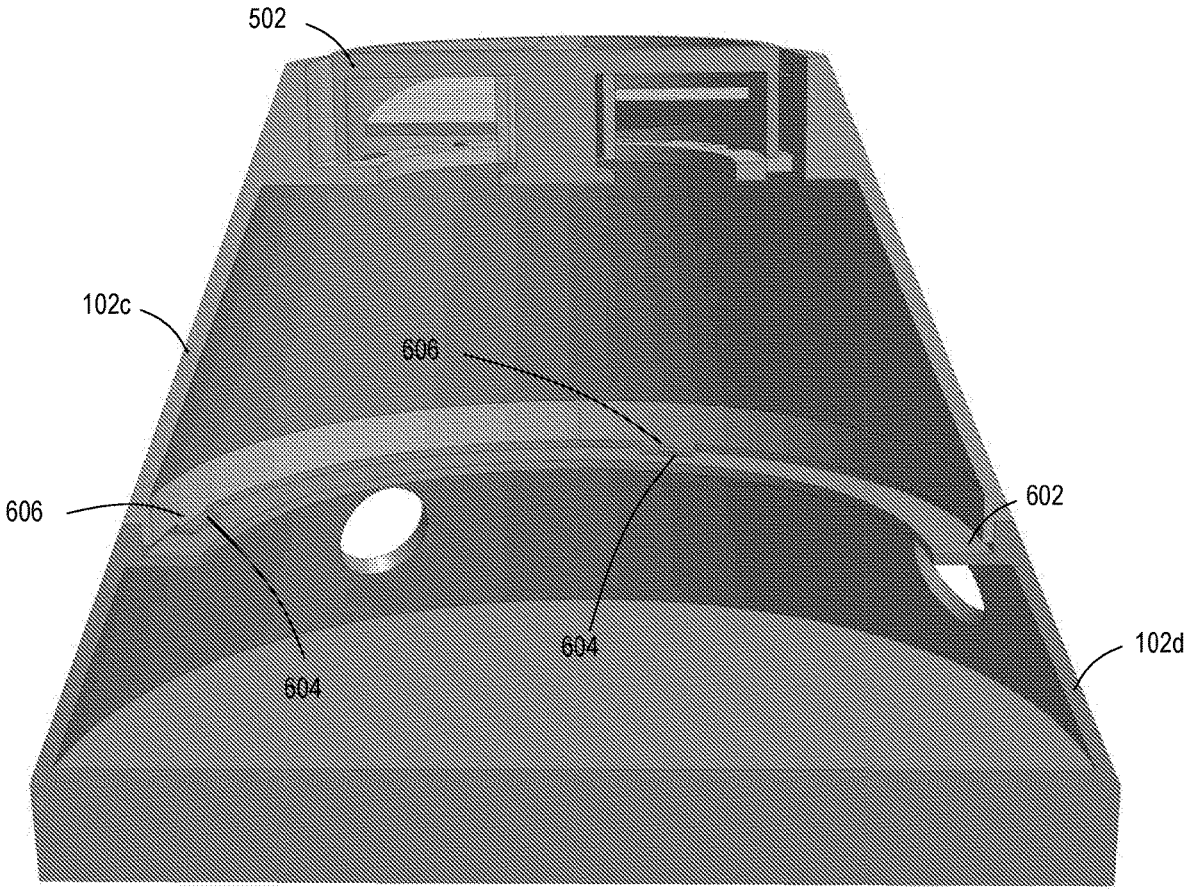
FIG. 6 illustrates a cross-sectional perspective view of electrical connections between a third housing portion and a fourth housing portion.

FIG. 6 illustrates a cross-sectional perspective view of electrical connections between a third housing portion 102*c* and a fourth housing portion 102*d*. The fourth housing portion 102*d* includes a flange 602 and an electrically conductive plate 604 disposed on the flange 604. The plate 604 may be metallic, e.g., chrome, copper, or gold. Preferably, the plate 604 is disposed on an upper surface of the flange 602. For illustration purposes in FIG. 6, the plate 604 is shown raised, e.g., protruding, from the upper surface of the flange. However, the plate 604 is preferable embedded in the flange 602 such that an upper surface of the plate 604 is flush, e.g., coplanar, with the upper surface of the flange 602.

Electrical wires (not shown) are conductively coupled to the plate 604 and a power supply 108 disposed in a base of the fourth housing portion 102*d* (see FIG. 2).

When the third housing portion 102*c* and the fourth housing portion 102*d* are coupled, the plate 604 would be conductively coupled to an electrically conductively knob 606. The knob 606 may be metallic, e.g., chrome, copper, or gold. Preferably, the plate 604 and the knob 606 are in physical contact with each other. Thus, electricity may be conducted from the power supply 108 via the electrical wires and plate 604 to the knob 606.

Electrical wires (not shown) are conductively coupled to the knob 606 and a fan 502 disposed in a disposed in the third housing portion 102*c*. (see FIG. 2). Thus, electricity may be conducted from the power supply 108 via the electrical wires, plate 604, and the knob 606 to the fan 502. The fan 502 is capable of being actuated when the third housing portion 102*c* and the fourth housing portion 102*d* are coupled.

Referring to the view of FIGS. 1-6, an operator may use an assembled smoking assembly 100 as follow. First, operator may dispose a first valve 402*a* into an intake aperture 106*a* of a second housing portion 102*b*. The operator may then couple the second housing portion 102*b* to a first housing portion 102*a*. The operation may dispose one or more knobs 110 of the first housing portion 102*a* into respective one or more slots 112 of the second housing portion 102*b*. The operator may rotate, e.g., clockwise or counterclockwise, the one or more knobs 110 relative to the one or more slots 112 to couple the first housing portion 102*a* to the second housing portion 102*b*.

Next, the operator may dispose a fan 502 into an intake aperture 106*a* of a third housing portion 102*c*. The operator may then couple the third housing portion 102*c* to a second housing portion 102*b*. The operation may dispose one or more knobs 110 of the second housing portion 102*b* into respective one or more slots 112 of the third housing portion 102*b*. The operator may rotate, e.g., clockwise or counter-clockwise, the one or more knobs 110 relative to the one or more slots 112 to couple the second housing portion 102*b* to the third housing portion 102*c*.

Additionally, the operator may dispose a second valve 402*b* into an intake aperture 106*a* of a fourth housing portion 102*d*. The operator may then couple the fourth housing portion 102*d* to a third housing portion 102*c*. The operation may dispose one or more knobs 110 of the third housing portion 102*c* into respective one or more slots 112 of the fourth housing portion 102*d*. The operator may rotate, e.g., clockwise or counter-clockwise, the one or more knobs 110 relative to the one or more slots 112 to couple the third housing portion 102*c* to the fourth housing portion 102*d*.

Moreover, coupling the third housing portion 102*c* to the fourth housing portion 102*d* would engage an electrically conductive plate 604 with an electrically conductive knob 606. Accordingly, the fan 502 may be receive electricity from a power supply 108 disposed in a base of the fourth housing portion 102*d*.

To operate the assembled smoking assembly 100, the operator may first dispose combustible material, e.g., cannabis, in an intake aperture 106*a* of a bowl 302. The combustible material may be set on a filter 310 that is also disposed in the intake aperture 106*a*. Next, the operator may rotate respective valve plates 404*a* on valves 402*a*, 402*b* to set the valves 402*a*, 402*b* to open positions. Also, the operator may turn on a fan 502. Blades 506 on the fan may rotate to cause air to be pulled through the bowl 302 and the first valve 402*a*. Afterwards, the operator may burn, e.g., with a lighter (not shown), the combustible material.

The operator may flip a switch (no shown) on the base of the fourth housing portion 104*d* to actuate the fan 502. The actuated fan 502 would draw downward smoke from the burning combustible material. The smoke may be drawn through the bowl 302 and filter 310 along with the air that may come through the bowl 302 and the filter 310. The pulled smoke and air may move past the blades 506, at which point, the blades 506 would push the smoke and air downward through the open second valve 404*b*. The pushed smoke and air may exit exhaust apertures 106*b* disposed in a lower portion of the smoking assembly 100.

To inhibit the amount of smoke exiting the exhaust apertures 106*b*, partially or fully, the operator may rotate a valve plate 404*a* of the valve 402*a* to a respectively partially or fully closed position.

To inhibit the amount of smoke entering the smoking assembly 100 partially or fully, the operator may rotate a valve plate 404*a* of the valve 402*b* to a respectively partially or fully closed position.

After using the smoking assembly, the operator may uncouple its components, e.g., housing portions, bowl, valves, and fan, to wash them.

What is claimed as the invention is:

1. A method of smoking combustible material(s), comprising:

providing a smoking assembly, comprising:

a first housing portion;

a second housing portion removably coupled and electrically coupled to the first housing portion;

an intake aperture disposed in the first hosing portion;

an exhaust aperture disposed in the second housing portion;

a fan disposed in first housing portion and electrically coupled to the first housing portion;

a power supply disposed in the second housing portion and electrically coupled to the second housing portion, wherein the fan is capable of receiving electricity from the power supply; and a valve disposed in either the first housing portion or the second housing portion, or both, wherein the valve has a valve handle extending through the housing;

burning combustible material above the intake aperture;

moving smoke from the burning combustible material and air downward in the housing and out through the exhaust aperture using the circular movement of the fan; and rotating the valve handle around the housing partially or fully inhibits air flow from the intake aperture to the exhaust aperture.

* * * * *